US007934456B1

(12) United States Patent
Heitmann et al.

(10) Patent No.: US 7,934,456 B1
(45) Date of Patent: May 3, 2011

(54) SABOT PROJECTILE

(75) Inventors: Thomas Heitmann, Unterluess (DE); Klaus-Dieter Freudenthal, Suderburg (DE); Michael Vagedes, Hermannsburg (DE)

(73) Assignee: Rheinmetall Waffe Munition GmbH, Unterleuss (DE)

( * ) Notice: Subject to any disclaimer, the term of this patent is extended or adjusted under 35 U.S.C. 154(b) by 90 days.

(21) Appl. No.: 12/567,306

(22) Filed: Sep. 25, 2009

Related U.S. Application Data

(60) Provisional application No. 61/199,807, filed on Nov. 20, 2008.

(51) Int. Cl.
*F42B 14/06* (2006.01)

(52) U.S. Cl. ..... 102/522; 102/520

(58) Field of Classification Search ..... 102/520, 102/521, 522, 523
See application file for complete search history.

(56) References Cited

U.S. PATENT DOCUMENTS 2,638,051 A * 5/1953 Critchfield ..... 102/522
2,992,612 A * 7/1961 Critchfield et al. ..... 102/522
2,998,779 A * 9/1961 MacRoberts ..... 102/523
3,430,571 A * 3/1969 Barr ..... 102/521
3,882,777 A * 5/1975 Rausing ..... 102/431
4,043,269 A * 8/1977 Ambrosini ..... 102/513
4,424,748 A * 1/1984 Schiff ..... 102/523
4,505,204 A * 3/1985 Wikstrom ..... 102/523
4,535,698 A * 8/1985 Yuen ..... 102/529
5,481,981 A * 1/1996 Sippel et al. ..... 102/522

* cited by examiner

*Primary Examiner* — J. Woodrow Eldred
*Assistant Examiner* — Gabriel J Klein
(74) *Attorney, Agent, or Firm* — Lucas & Mercanti, LLP; Klaus P. Stoffel

(57) ABSTRACT

A sabot projectile with a subcaliber penetrator and a sabot, which has a propulsion element that acts on the rear end of the penetrator, a segmented, essentially cylindrical guide cage, which is connected to the front end of the propulsion element, and a segmented, disk-shaped metal guide element that extends radially inward in the front area of the guide cage and holds the penetrator. The disk-shaped guide element has a slightly convex contour in the direction of flight of the projectile and the material and the wall thickness of the guide element are chosen in such a way that convex area of the guide element is pushed back slightly when the sabot projectile is fired, so that the outer marginal area of the guide element rests against the inside wall of the gun barrel from which the sabot projectile is fired, and/or the inner marginal area of the guide element, which faces the penetrator, rests against the outer surface of the penetrator.

5 Claims, 1 Drawing Sheet

1/1
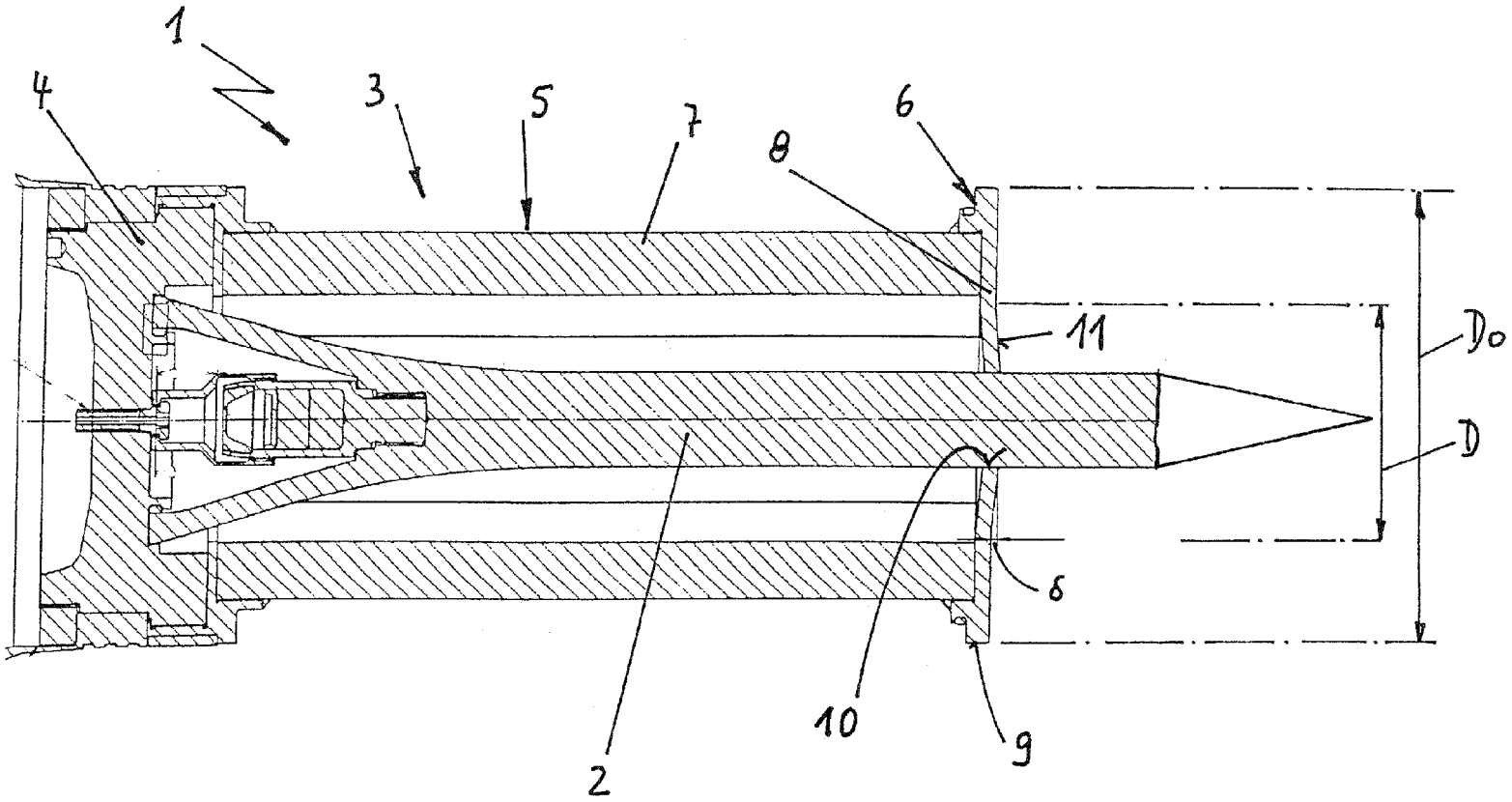

SABOT PROJECTILE

This application is a conventional application of the Provisional Application U.S. 61/199,807 filed Nov. 20, 2008, which in turn claims the priority of DE 10 2008 049 146.2 filed Sep. 26, 2008, the priority of both applications is hereby claimed and both applications are incorporated by reference herein.

BACKGROUND OF THE INVENTION

The invention concerns a sabot projectile with a subcaliber penetrator and a sabot, which comprises a propulsion element that acts on the rear end of the penetrator, a segmented, essentially cylindrical guide cage, which is connected to the front end of the propulsion element, and a segmented, disk-shaped metal guide element that extends radially inward in the front area of the guide cage and holds the penetrator.

A sabot projectile of this type is disclosed, for example, by DE 43 30 417 C2. It has an essentially hollow cylindrical aluminum or plastic guide cage that consists of two segments and is joined as a single piece with the disk-shaped guide element.

In a guide cage that has an integrated guide element and is made of aluminum or some other metal, the portion of the sabot projectile that is dead load is relatively high. On the other hand, if the guide cage and the guide element are both made of plastic, it has been found in practice that the front guide region is too soft, so that radial deviations of the penetrator can occur during the passage of the sabot projectile through the gun barrel, which can lead to the destruction of the front guide region of the sabot.

Therefore, it has already been proposed that the guide cage be produced from a fiber-reinforced plastic and the disk-shaped guide element be produced from a metal, preferably an aluminum alloy, and that the two parts then be joined by a form-locking and/or frictional connection. Due to the high modulus of elasticity of a guide element made of metal, the guide element is better able to absorb shearing forces than a corresponding guide element made of fiber-reinforced plastic. The relatively light guide cage made of fiber-reinforced plastic then only needs to hold the metal guide element in its axial position during the axial acceleration of the sabot projectile in a corresponding gun barrel.

However, it has been found that, due to the design-related basic play between the inside wall of the gun barrel from which the sabot projectile is to be fired and the outer periphery of the disk-shaped guide element, the guide element can buckle and break as a result of the high axial acceleration of the projectile in the gun barrel in the areas not supported by the wall of the gun barrel.

The unpublished patent application DE 10 2008 029 395.4 relates to the use of light metal (for example, an aluminum or magnesium alloy) for guide cages of this type. This makes it possible to produce them in an especially cost-effective way if a section is extruded and then finished (for example, the section is bored out) and segmented or divided in the axial direction.

SUMMARY OF THE INVENTION

The present invention provides a cost-effective and weight-optimized sabot projectile of the aforementioned type, in which breaking of the disk-shaped guide element is avoided when the projectile is fired, so that exact radial guidance of the penetrator is ensured.

The basic idea of the invention is to design the disk-shaped guide element in such a way that it has a contour that is slightly convex in the direction of flight of the projectile. The material and the wall thickness of the guide element are chosen in such a way that the convex region of the guide element is pushed back slightly when the sabot projectile is fired, so that the outer marginal area of the guide element rests against the inside wall of the gun barrel and/or the inner marginal area of the guide element, which faces the penetrator, rests against the outer surface of the penetrator.

It has been found to be advantageous if the disk-shaped guide element has, as its convex curvature, a conically tapered contour in the direction of flight of the projectile. In this regard, this convex curvature needs to be present only in a circular segment around the penetrator. The outside diameter D of this circular segment can be, for example, 50% of the projectile caliber Do.

In the case of a light-metal propulsion element with a conically tapered contour, the maximum conical angle can be less than 10° and in one practical embodiment was preferably 5°.

Further details and advantages of the invention are explained with reference to the specific embodiment illustrated in the FIGURE.

BRIEF DESCRIPTION OF THE DRAWINGS

The FIGURE shows a longitudinal section through the sabot projectile of the invention.

DETAILED DESCRIPTION OF THE INVENTION

The sabot projectile 1 comprises a subcaliber penetrator 2, which has a conical tailpiece, and a sabot 3.

The sabot 3 consists essentially of a multisectional propulsion element 4, which is made of an aluminum alloy and acts on the rear end of the penetrator 2, a cylindrical guide cage 5 connected to the front end of the propulsion element 4, and a disk-shaped guide element 6, which is located in the front area of the guide cage 5 and extends radially inward to support the penetrator 2.

The guide cage 5 consists of two segments 7, which are shaped like half shells and are preferably formed as extruded aluminum sections.

The disk-shaped guide element 6 also consists of two metal half disks 8. Here too, the drawing shows only one half disk 8, while the second half disk is located in front of the plane of the paper facing the observer.

In accordance with the invention, the central region of the disk-shaped guide element 6 that borders on the penetrator 2 has a contour 11 that tapers conically in the direction of flight of the projectile 1. In this regard, the material and the dimensions of the guide element 6 are chosen in such a way that the guide element 6 is pushed back slightly when the sabot projectile 1 is fired. The resulting increase in diameter of the guide element 6 causes the outer marginal area 9 of the guide element 6 to rest against the inside wall of the gun barrel (not shown) from which the projectile is fired.

The same is true for the inner marginal area 10 of the guide element 6, which faces the penetrator 2 and rests against the outer surface of the penetrator 2 in a form-locking and frictionally connected way, so that the tolerances predetermined by the design (joint play between the disk-shaped guide element 6 and the penetrator 2 and interface play between the gun barrel and the guide element 6) are compensated, and optimal radial guidance of the sabot projectile 1 in the corresponding gun barrel is guaranteed.

Due to the support of the two half disks 8 of the guide element 6 on the penetrator 2, deflection of the disk-shaped guide element 6 beyond its vertical position is generally prevented.

In a practical embodiment of a sabot projectile of the invention with a projectile caliber Do of 120 mm, the diameter D of the circular segment, within which the contour that tapers in the direction of flight of the penetrator 2 is located, is about 50% of the projectile caliber. In this regard, the conical angle d of the tapered contour was about 5°, and the wall thickness of the guide element, which consisted of an aluminum alloy, was 4 mm.

Naturally, the invention is not limited to the embodiments described above. For example, the guide element can be made from a metal other than aluminum. In addition, it is not absolutely necessary for the convex curvature of the guide element to be conical, but rather it could have the shape of a spherical segment instead.

Moreover, it is also possible for the guide cage and the guide element to consist of more than two segments. Of course, the dividing lines of the guide cage and the guide element should still follow one another axially to ensure satisfactory discarding of the segments as soon as the sabot projectile has left the gun barrel.

Although the present invention has been described in relation to particular embodiments thereof. Many other variations and modifications and other uses will become more apparent to those skilled in the art. it is preferred, therefore, that the present invention be limited not by the specific disclosure herein, but only by the appended claims.

The invention claimed is:

1. A sabot projectile, comprising: a subcaliber penetrator; and a sabot, the sabot including a propulsion element that acts on a rear end of the penetrator, a segmented, essentially cylindrical guide cage, which is connected to a front end of the propulsion element, and a segmented, disk-shaped metal guide element that extends radially inward in a front area of the guide cage and holds the penetrator, wherein the disk-shaped guide element has a convex contour that extends in a direction of flight of the projectile, wherein the guide element is dimensioned and of a material so that the guide element is pushed back slightly when the sabot projectile is fired, whereby an outer marginal area of the guide element is restable against an inside wall of a gun barrel from which the sabot projectile is fired, and/or an inner marginal area of the guide element rests against an outer surface of the penetrator.

2. A sabot projectile in accordance with claim 1, wherein the disk-shaped guide element has a conically tapered contour in the direction of flight of the projectile.

3. A sabot projectile in accordance with claim 2, wherein the disk-shaped guide element has a contour that tapers in the direction of flight of the penetrator only in a circular segment around the penetrator, the circular segment having diameter D that is at most 50% of a projectile caliber Do.

4. A sabot projectile in accordance with claim 3, wherein the propulsion element is made of a light metal and a maximum conical angle (δ) of the conically tapered contour is less than 10°.

5. A sabot projectile in accordance with claim 4, wherein the maximum conical angle is 5°.

* * * * *